US005427125A

United States Patent [19]

Meza

[11] Patent Number: 5,427,125

[45] Date of Patent: Jun. 27, 1995

[54] LAVATORIES AND THE LIKE CLEANING APPLIANCE

[75] Inventor: Gerardo A. Meza, San Jose', Costa Rica

[73] Assignee: Mortech Technologies of North America Ltd., Dover, Del.

[21] Appl. No.: 207,919

[22] Filed: Mar. 8, 1994

[51] Int. Cl.[6] ..... B08B 3/02

[52] U.S. Cl. ..... 134/95.3; 134/198; 134/201; 141/349; 239/375

[58] Field of Search ..... 134/198, 201, 95.3; 239/99, 375; 141/230, 349, 348, 390

[56] References Cited

U.S. PATENT DOCUMENTS

| | | | |
|---|---|---|---|
| 497,896 | 5/1893 | Ruppel | 141/349 X |
| 2,362,885 | 11/1944 | Clark et al. | 239/375 X |
| 2,613,995 | 10/1952 | Reinhold | 239/375 X |
| 3,181,737 | 5/1965 | Chaucer | 141/349 X |
| 3,455,507 | 7/1969 | Ryder et al. | 239/375 |
| 3,997,115 | 12/1976 | Licudine | 239/375 X |
| 4,485,971 | 12/1984 | Pajevic | 239/375 X |
| 5,031,676 | 7/1991 | Ulm | 141/349 |
| 5,150,841 | 9/1992 | Silvenis et al. | 239/375 X |
| 5,221,050 | 6/1993 | Jefferies et al. | 239/375 X |
| 5,244,124 | 9/1993 | Raffo | 239/375 |

*Primary Examiner*—Frankie L. Stinson

*Attorney, Agent, or Firm*—Hedman, Gibson & Costigan

[57] ABSTRACT

This appliance for the cleaning of lavatories and the like has the peculiar feature of an inside water tank, a high pressure pump producing water jets for the removal of faecal residuals, a steam generator producing jets for the sterilization of the surfaces to be cleaned, an electric rechargeable battery. This appliance comprises a container that serves for both the water and electricity supply that is necessary for future use.

1 Claim, 1 Drawing Sheet

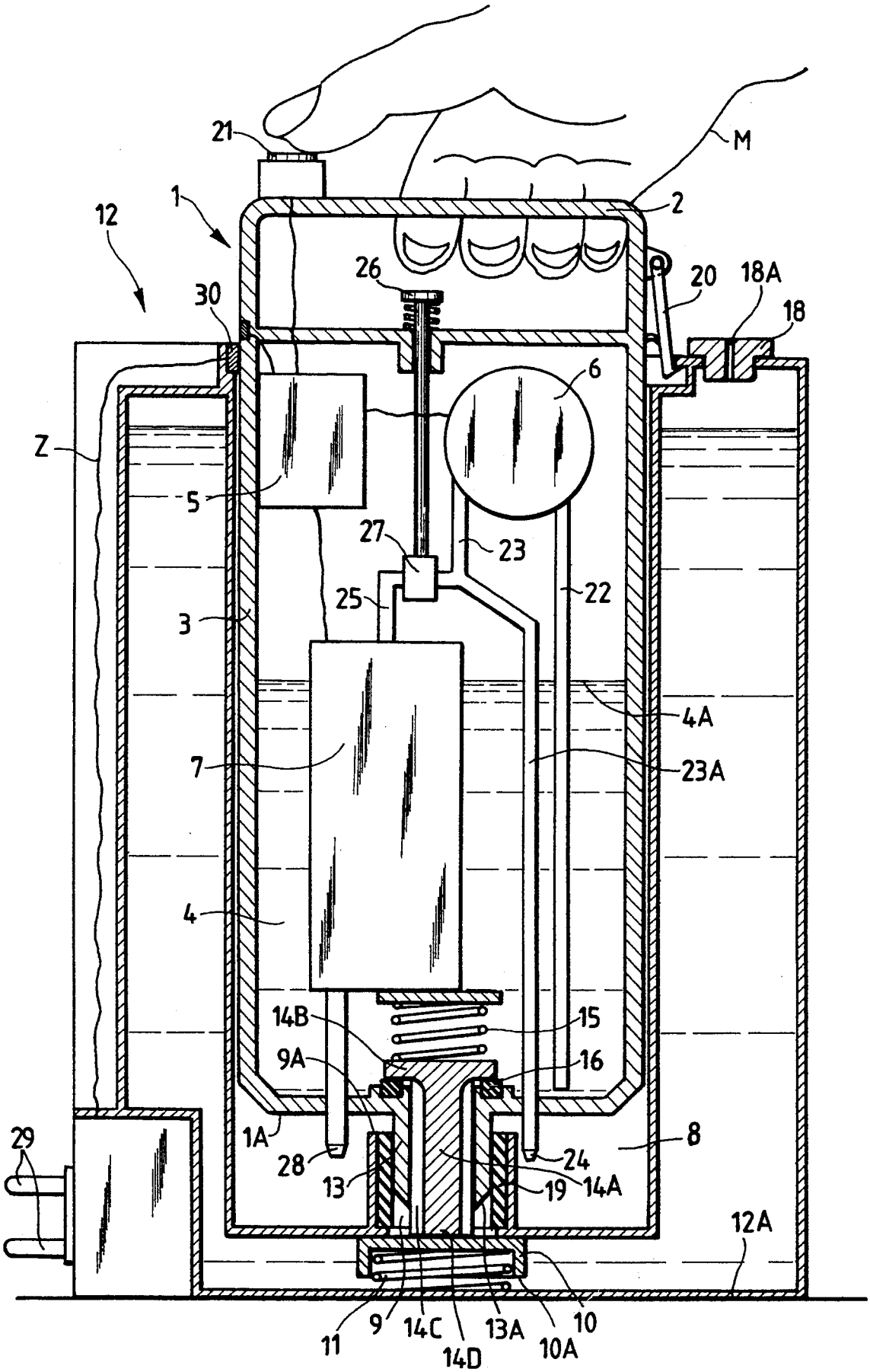
21
M
1
2
12
26
20
18A
30
18
6
Z
5
27
23
25
22
3
4A
7
23A
4
14B
15
9A
16
1A
8
29
28
24
13
19
14A
12A
11
9
14C
13A
10
14D
10A

LAVATORIES AND THE LIKE CLEANING APPLIANCE

This invention relates to an appliance for the cleaning of lavatories and the like. As it is known, the cleaning and hygiene of lavatories and the like is often difficult, especially when a lot of people are involved and they neglect the rights of anyone who will use the toilet after them.

Therefore, it is often necessary for hygiene to cover the lavatory seat by paper or by other means of cleaning such as "brushes", which are not willingly handled since they have to clean what other people have used.

The purpose of the present invention is to manufacture an appliance able to remove filthiness in lavatories and the like effectively and without direct contact.

A further purpose is to make an appliance able to disinfect parts without touching them.

These and further purposes will be explained in the following detailed description showing an appliance for the cleaning of lavatories and the like with the peculiar feature of an inside water tank, a high pressure pump producing water jets for the removal of faecal residuals, a steam generator producing jets for the sterilization of the surfaces to be cleaned, an electric rechargeable battery. This appliance comprises a container that serves for both the water and electricity supply that is necessary for future use.

The appliance is shown as an example in the enclosed drawing, in section and partially located into its container.

With reference to the above drawing, the appliance (1) has one fixed handle (2) joined to a hollow body (3) acting as water tank (4). Inside the appliance, in watertight spaces (4) there is a rechargeable electric battery (5), a high pressure hydraulic pump (6), a steam generator (7).

Such an appliance (1) is situated in a conjugated housing (8) of a container (12), which has a central hole (9) in the bottom closed by a rubber lid (10) pressed by a spring (11). Having located the appliance (1) in the conjugated housing (8) of the container (12), a tubular offshoot (13) of the appliance (1) goes into the hole (9). Inside this offshoot, there is the stem of the head valve equipped with a tighting disk (14B); the tighting action is done by a spring (15) and the support of a rubber gasket (16). The stem (14A) has longitudinal grooves (14C).

The bottom stem end (14D) sticks out the bottom tubular offshoot end (13A), so that when the tubular offshoot (13) is being inserted into the hole (9), such an end (14D) leans on the rubber lid (10).

As the spring (15) is more rigid than the spring (11), when the tubular offshoot (13) is being put into the hole (9), the stem end (14D) presses the spring (11) pushing it towards the bottom of the rubber lid (10) so that the edges (10A) can lean on the bottom (12A) of the container (12).

In this way the stem (14A) meets a stronger resistance that prevents it from going further; since all this allows the tubular offshoot (13) to go further than the stem (14A) inside the hole (9), a hard enough force is obtained to press the spring (15) and therefore to create the clearance between the tighting disk (14B) and the rubber gasket (16), Such a penetration of the tubular offshoot (13) inside the hole (9) carries on as far as one end (9A) of the constitutive columnar body comes in contact with the bottom of the surface (1A) of the appliance (1).

As the appliance is so configurated, the hole (9) is open and the longitudinal grooves (14C) too ape open, being no longer closed by the rubber gasket (16) .

In this way the inside of the container (12) and the inside of the appliance (1) are connected. Inside the container (12) there is a water level (17), produced by the means of a water injection through an ordinary lid (18) equipped with a breather hole (18A) or a non-airtight lid; as the water level (17) is higher than the (4A) level inside the appliance (1), there is water pouring between the two rooms to obtain the same level, from the well-known principle of the "communicating vessels".

In this way the appliance (1) is filled by water every time it is put into the container (12). Since the container (12) has a very high capacity, (it can be made in whatever form and volume), several consequent refillings of the appliance (1) can be carried out.

When the appliance (1) has to be used, it has to be hold with the hand M using the handle (2) to extract it from the container (12), overcoming the resistance made by the rubber gasket (19), which gives the watertight sealing between the tubular offshoot (13) and the constitutive columnar offshoot of the hole If the extraction of the appliance (1) with minor effort is desired, the correct positioning of the appliance (1) into the container (12) could be obtained by an ordinary spring-lock device (20).

The extraction of the appliance (1) from the container (12) breaks the connection between the two parts by the locking action made by the two springs (15) and (11).

The appliance (1) is therefore easy to handle without any tie to its container (12), and can be easily used.

Its functions are guaranteed by the rechargeable electric battery (5) which feeds the hydraulic pump (6). A control button (21) of such pump drains through a pipe (22) the water contained in the hollow body (3) and sends it at high pressure into a pipe (23) which leads through a channel (23A) to a nozzle (24), from which a strong cleaning jet sprays.

The pipe (23) feeds the channel (23A) and besides it can feed by selection another channel (25). Such a selection is controlled by a second button (26) which, by usual electric or mechanical means (27), allows to deviate water passing in the pipe (23) to the pipe (25). From this pipe (25) water flows into the metallic evaporation body (7), made of a metallic mass heated by electric resistance, and crossed by channels where water is completely evaporated, it being in contact with the overheated walls. Steam jets easily spray out from such a steam generator (7), and by a nozzle (28), and can be directed towards things to be sterilized.

The container (12) is equipped with a plug (29) by means of which it can be connected to the domestic system.

Such a current is then transformed into low voltage and rectified by well-known methods of recharging the battery (5) of the appliance.

The electric connection among the parts is made by safety contacts, shown under 30, as per well-known methods. The electric connecting wires are indicated with a zig-zag line Z.

I claim:

1. Appliance (1) for cleaning lavatories said appliance having an inside hollow body (3), a water tank (4), a hydraulic high pressure pump (6) producing water jets for removal of faecal residuals, a steam generator (7) producing jets for sterilization of the surfaces to be cleaned, a rechargeable electric battery (5), said appliance including a container (12) that holds both the water and electricity supply necessary for future use, said appliance (1) being automatically refillable by a higher water level (17) inside the container (12) in comparison with the water level (4A) inside the appliance (1), by means of a hydraulic connection between said container (12) and said appliance (1) through holes opened by tightening spring valves said a rubber gasket (16) by a first spring (15) said stem end valves comprising a stem (14A) having longitudinal grooves (14C), a disk (14B) which pressed tightly against having an end (14D) which is movable against rubber lid (10) to cause the lowering of said rubber lid (10) against a second antagonist spring (11) which is weaker than said first spring (15), a tubular offshoot (13) at the bottom of appliance (1) which extends downwardly from said appliance and defines an opening into said appliance (1), said tubular offshoot (13) engaging a columnar body (9A) equipped with a rubber gasket (19) up to an end stroke device (9A-1A) at the interior bottom of said container (12), the upward pressure of the springs (11, 15) being opposed either by said rubber gasket (19) or by spring-lock devices (20).

* * * * *